US007708176B2

(12) United States Patent
Chuang et al.

(10) Patent No.: US 7,708,176 B2
(45) Date of Patent: May 4, 2010

(54) WEB TRANSPORTATION GUIDING APPARATUS AND METHOD

(75) Inventors: Chia-Cheng Chuang, Tainan (TW); Chih-Yu Ke, Pingtung County (TW); Chin-Lung Liu, Kaohsiung County (TW); Chih-Jen Tsai, Taitung County (TW); Chung-Hsin Hsiao, Chiayi County (TW); Chang-Chou Li, Tainan (TW)

(73) Assignee: Industrial Technology Research Institute, Hsin-chu (TW)

( * ) Notice: Subject to any disclaimer, the term of this patent is extended or adjusted under 35 U.S.C. 154(b) by 0 days.

(21) Appl. No.: 12/273,049

(22) Filed: Nov. 18, 2008

(65) Prior Publication Data

US 2010/0072244 A1 Mar. 25, 2010

(30) Foreign Application Priority Data

Sep. 24, 2008 (TW) ..... 97136579 A

(51) Int. Cl.
*B65H 43/08* (2006.01)
*B65H 20/00* (2006.01)

(52) U.S. Cl. ..... 226/20; 226/95; 226/97.3

(58) Field of Classification Search ..... 226/95, 226/97.3, 15, 19, 20; 242/615.11
See application file for complete search history.

(56) References Cited

U.S. PATENT DOCUMENTS 3,549,098 A * 12/1970 Koskela et al. ..... 242/542.4
3,587,962 A * 6/1971 Leverkusen et al. ..... 226/95
4,328,626 A * 5/1982 Leitner ..... 34/115
4,453,659 A 6/1984 Torpey
4,888,848 A * 12/1989 Serracant-Clermont et al. ..... 15/309.1
4,919,319 A * 4/1990 Ford et al. ..... 242/615.12
4,958,111 A 9/1990 Gago
5,087,313 A * 2/1992 Duecker ..... 156/271
5,104,489 A * 4/1992 Beisswanger et al. ..... 162/369
5,114,062 A * 5/1992 Kuhn et al. ..... 226/95
5,232,141 A * 8/1993 Mittmeyer et al. ..... 226/95
5,358,163 A * 10/1994 Naka ..... 226/95
5,489,784 A * 2/1996 Koiranen et al. ..... 250/548
5,554,262 A * 9/1996 Turner ..... 162/198
5,915,648 A * 6/1999 Madrzak et al. ..... 242/615.2
6,004,432 A * 12/1999 Page et al. ..... 162/281
6,038,976 A * 3/2000 Helmstadter et al. ..... 101/410
6,124,201 A 9/2000 Wang et al.
6,250,581 B1 * 6/2001 Cramer ..... 242/541.7
6,328,194 B1 * 12/2001 Meschenmoser ..... 226/95
6,364,247 B1 * 4/2002 Polkinghorne ..... 242/615.11
6,488,194 B1 * 12/2002 Couturier ..... 226/95
6,705,220 B2 3/2004 Boucher
6,739,489 B1 * 5/2004 Nicolai et al. ..... 226/95

(Continued)

*Primary Examiner*—Evan H Langdon
(74) *Attorney, Agent, or Firm*—Rabin & Berdo, P.C.

(57) ABSTRACT

A guiding apparatus and method for a shift generated by a web during web transportation is provided, in which a coarse position guiding module and a fine position guiding module function to directly adjust the web so as to compensate the shift occurred during the process of transportation according to a position of the web. By means of monitoring a location of the fine position guiding module at any time, a reference of the coarse position guiding module will be adjusted when the location of the fine position guiding module satisfies the condition defined in the guiding method, so as to change a position where the web enters into the fine position guiding module.

25 Claims, 16 Drawing Sheets

U.S. PATENT DOCUMENTS 6,786,449 B2 * 9/2004 Marcle-Geler et al. . 242/615.12
7,025,303 B2 * 4/2006 Meyer ..... 242/615.12
7,267,255 B1 9/2007 Young et al.
7,311,234 B2 * 12/2007 Solberg ..... 226/97.3
7,383,772 B2 * 6/2008 Boppel et al. ..... 101/228
2002/0113164 A1 * 8/2002 Marcle-Geler et al. . 242/615.12
2006/0097101 A1 * 5/2006 Boppel et al. ..... 242/615.12
2006/0261120 A1 * 11/2006 Slyne ..... 226/95
2007/0102563 A1 * 5/2007 Kubota et al. ..... 242/548
2008/0176728 A1 * 7/2008 Scheu ..... 492/8

* cited by examiner

WEB TRANSPORTATION GUIDING APPARATUS AND METHOD

BACKGROUND OF THE INVENTION

1. Field of Invention

The present invention relates to a position guiding technology, and more particularly to a web transportation guiding apparatus and method for guiding a position shift occurred during web transportation.

2. Related Art

FIG. 1 is a schematic view illustrating that a web has a shift. Since the web 90 has had a lateral shift δ during a winding, which causes a situation that the web 90 snakes when being unwound through a roller 10. An edge of the web 90 continuously shifts from a position of c towards a position of d during the unwinding, such that a lateral shift on the edge after the web 90 is unwound is exactly δ. The above situation is merely one of the causes for the snaking of the web. Moreover, the inconsistent parallelism between the rollers in a roll to roll equipment is a common reason why the web snakes. Therefore, a good edge tracing guiding module is needed to effectively solve the problem of the snaking of the web.

A swing-type edge tracing guiding apparatus available on the market is generally used during the web transportation, however, some problems cannot be directly alleviated in usage. Not because the usage of the swing-type edge tracing guiding apparatus has disadvantages, but the principle of the swing-type edge tracing restricts the overall guiding precision and response speed in some special situations. FIG. 2 is a schematic view of the swing-type edge tracing guiding apparatus. In the swing-type guiding apparatus in the prior art, the web shift must be compensated by rotating a specific angle for the swing-type edge tracing guiding apparatus. Therefore, when a tiny shift is to be compensated, a driving apparatus must have a higher angle resolution to compensate the tiny shift precisely.

In addition, in FIG. 2, for a sensor 11, the web before a critical line A has a tendency of shifting to the right. Therefore, when the web before the critical line A reaches the sensor, an included angle θ1 must be formed between the swing-type edge tracing guiding apparatus and the critical line A, so as to effectively maintain the edge position of the web at a reference O. However, it should be particularly noted that once the web after the critical line A reaches the sensor, since the web has a tendency of shifting to the left for the sensor, the swing-type edge tracing guiding apparatus must be driven immediately to form an included angle θ2 with the critical line A, so as to effectively maintain the edge position of the web at the reference O. It should be noted that the swing-type edge tracing guiding apparatus must be rotated by an angle of θ1+θ2 in an extremely short time, but the swing-type edge tracing guiding apparatus is hardly able to respond with a proper angle in time, such that the edge position of the web is deviated from the reference O.

FIG. 3 is a schematic view illustrating an error of a swing-type edge tracing guidance in the prior art. An edge position of a web 18 is measured by a sensor 24 that is generally placed between rollers 16 and 22, and a transportation reference of the web 18 is set at a position at a distance X from a point C. The roller 16 may swing left and right, so as to compensate the shift during the transportation of the web 18. As shown in FIG. 3, when a shift occurs to the web 18 during the transportation, an included angle D is formed between the roller 16 and the roller 22 in order to compensate the shift, and thus a deflection is generated in a region 28 between the rollers 16 and 22. Although the position of the web 18 detected by the sensor 24 has always been maintained at X, the position of the web 18 after leaving the roller 24 has been changed to Y due to a distance between the sensor 24 and the roller 22. Therefore, a compensation error δ is generated, and δ=X−Y.

In another guiding manner, a translation-type guiding apparatus is used, but a situation in which a moving travel 12 of a linear moving platform reaches a travel limit (as shown in FIG. 4A) may occur to the apparatus, such that the function of adjusting a shift of a web 90 is restricted. Moreover, a situation in which the web 90 shifts beyond a clamping range of a roller 13 (as shown in FIG. 4B) may occur to the translation-type guiding apparatus. The two situations often occur during the usage of the translation-type guiding apparatus. When encountering the above situations in FIGS. 4A and 4B, those of ordinary skill in the art often wrongly believe that the problems lie in an insufficient roller length or motor travel, and that the problems can be alleviated as long as the roller length or motor travel is increased. However, this is always not the case. Even if the roller length or motor travel is increased, the time points at which the above situations occur are delayed, but these problems cannot be solved effectively.

Furthermore, U.S. Pat. No. 7,267,255 has disclosed a web trace adjustment apparatus in which a driving wheel capable of adjusting a shift is disposed in a gimbal direction, so as to adjust a trace along which a web intends to move. U.S. Pat. No. 6,705,220 has disclosed a web trace adjustment apparatus in which a pair of movable angle bars is used to guide a moving web to enter into or move out of a transportation system.

Additionally, U.S. Pat. No. 6,124,201 has also disclosed a web guiding manner, in which a side edge position of a web is monitored, and the position of the web is guided by an upstream guiding apparatus if a shift is found. In addition, U.S. Pat. No. 4,958,111 and U.S. Pat. No. 4,453,659 have also disclosed an apparatus for adjusting a web position.

SUMMARY OF THE INVENTION

The present invention is directed to a web transportation guiding apparatus, which detects a position of a side edge of a web to compensate and adjust the position of the side edge of the web in the web transportation in real time by a mechanism having a coarse adjustment and a fine adjustment if the position of the web is shifted.

The present invention is directed to a web transportation guiding method, which not only detects a position of a side edge of a web to compensate and adjust the position of the web in a transportation by a mechanism having a coarse adjustment and a fine adjustment, but also is capable of determining the fine adjustment mechanism about a moving limit, and controlling the coarse adjustment mechanism to change an edge tracing determination position reference thereof if the fine adjustment mechanism satisfies a condition for the moving limit.

The present invention is directed to a web transportation guiding apparatus and method that uses a coarse guiding module in combination with a fine guiding module. The fine guiding module is capable of meeting the demand for a high-precision edge tracing, and the coarse guiding module is capable of effectively solving the problem that the translation-type fine guiding module reaches a limit point, thereby realizing the web edge tracing technology with high-precision.

In an embodiment, the present invention provides a web transportation guiding apparatus, which includes a coarse position guiding module, a fine position guiding module, and a control module. The coarse position guiding module determines a position of a specific position on a web according to a reference sensor, so as to compensate a shift generated by the web during the web transportation. The fine position guiding module is disposed at one side of the coarse position guiding module, and compensates the shift generated by the web during the transportation according to the position of the specific position on the web. The control module determines whether to send a control signal to the coarse position guiding module according to a position of the fine position guiding module, so as to change the position reference.

In another embodiment, the present invention further provides a web transportation guiding method including the following steps. A coarse position guiding module and a fine position guiding module are provided, which are respectively provided for a web to pass through and may adjust a position of the web. The coarse position guiding module determines whether the position of the web is shifted according to a reference. If the fine position guiding module approaches a limit of the moving travel, the coarse position guiding module is notified to change the reference.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to make the features, objectives, and functions of the present invention become more comprehensible, the structures and design ideas and reasons of relevant details of the apparatus in the present invention are illustrated below. The detailed illustration is stated as follows.

Figure 2:
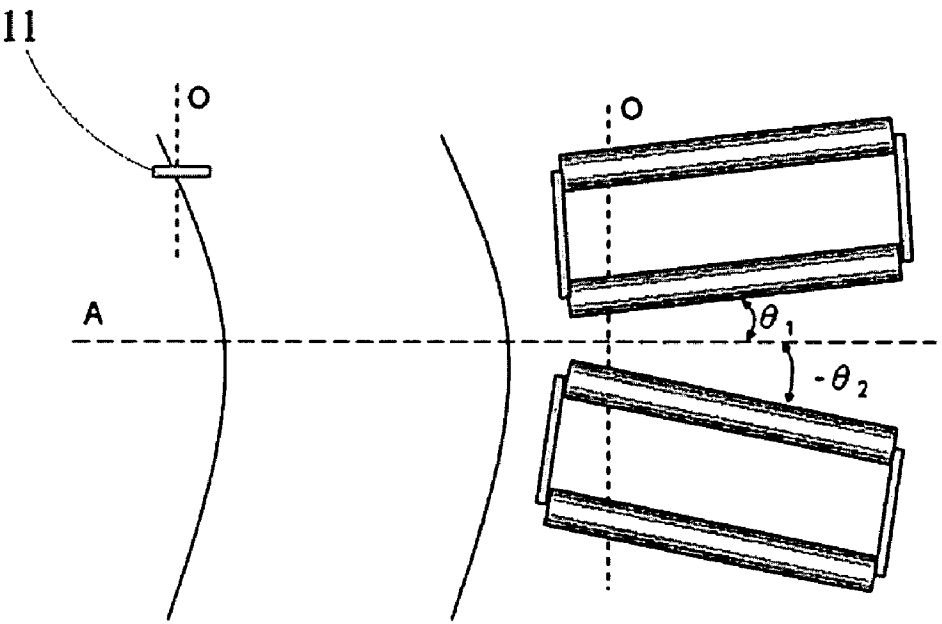
FIG. 2 PRIOR ART
FIG. 2 is a schematic view of a swing-type edge tracing guiding apparatus.
Figure 1:
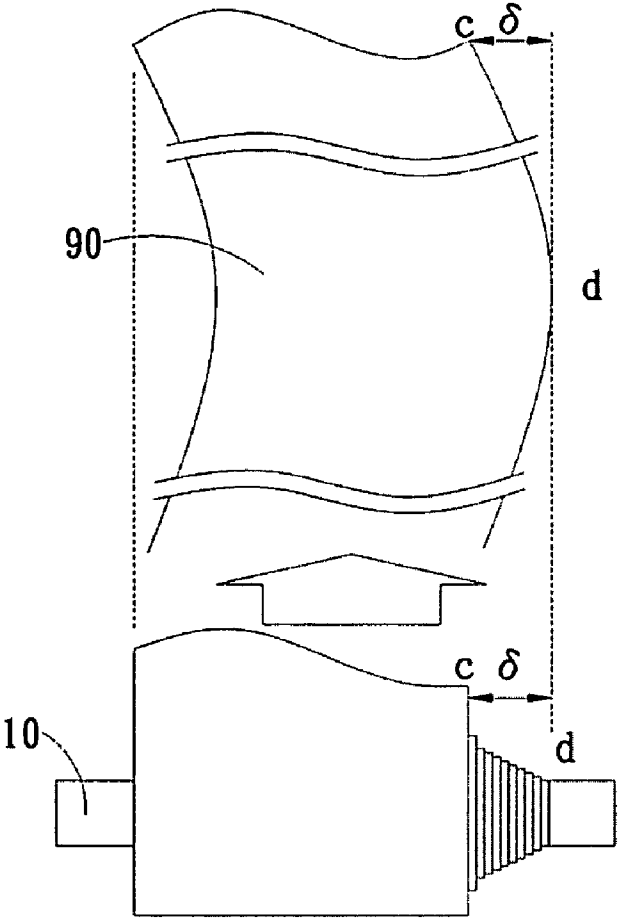
FIG. 1 PRIOR ART
FIG. 1 is a schematic view illustrating that a web generates a shift.
Figure 3:
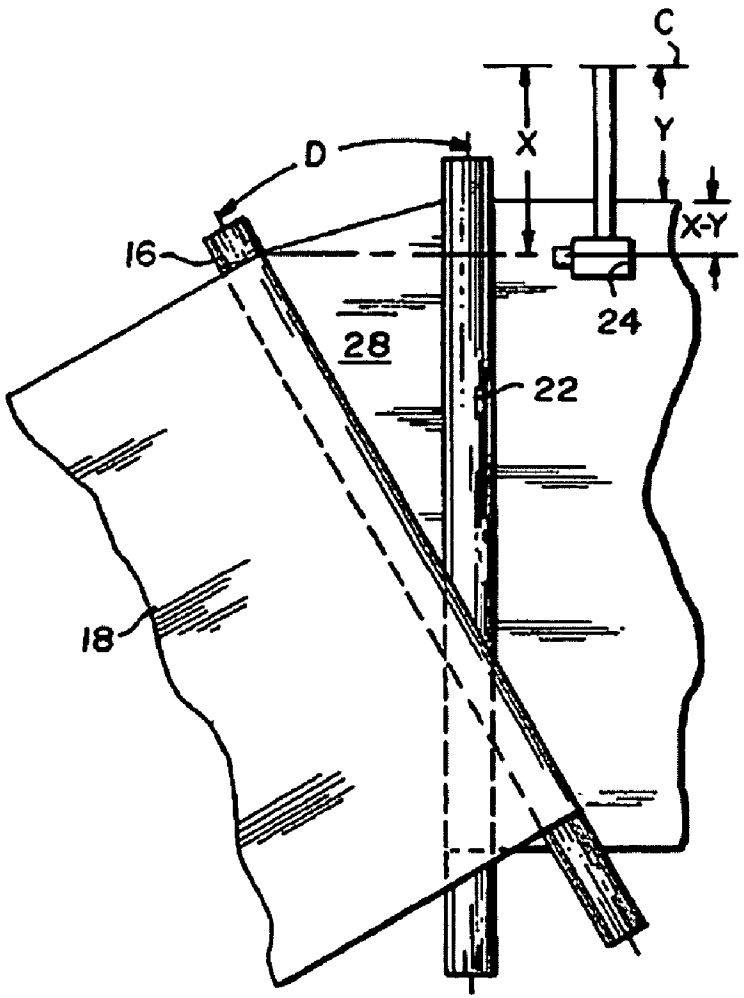
FIG. 3 PRIOR ART
FIG. 3 is a schematic view illustrating an error of a swing-type edge tracing guidance in the prior art.
Figure 4B:
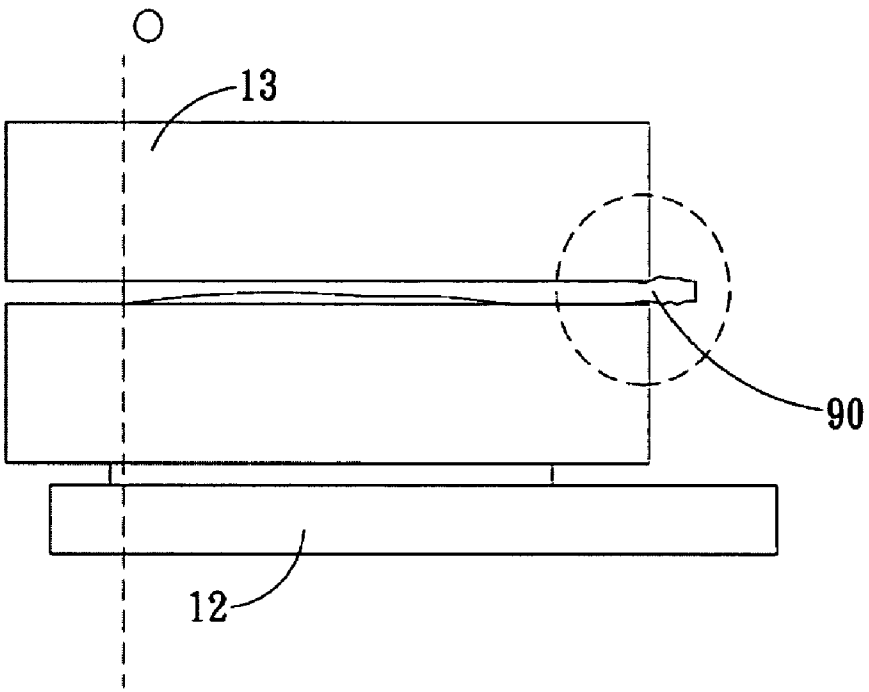
FIGS. 4A and 4B are schematic views illustrating a moving limit of a linear moving platform.
Figure 4A:
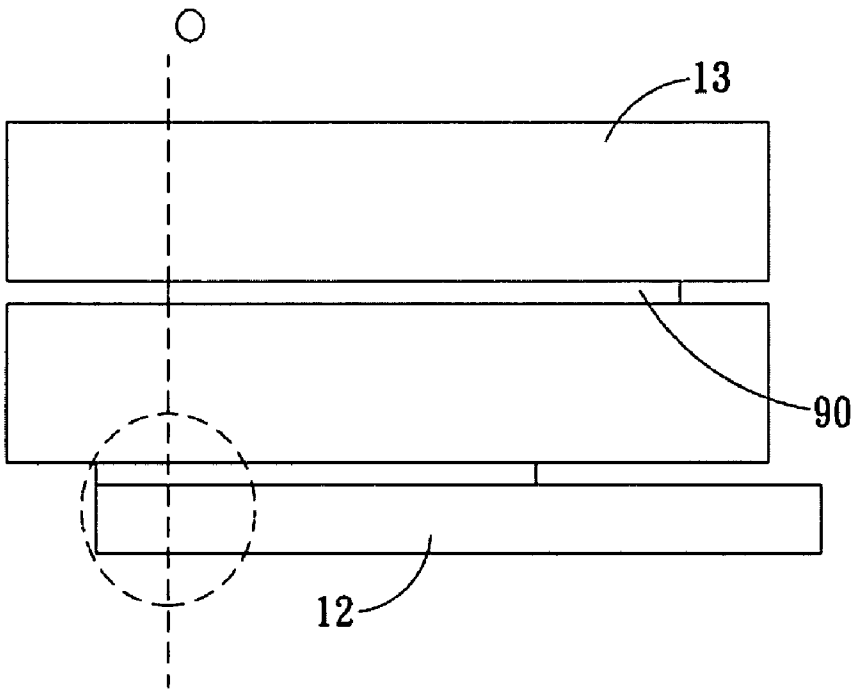
Figure 5:
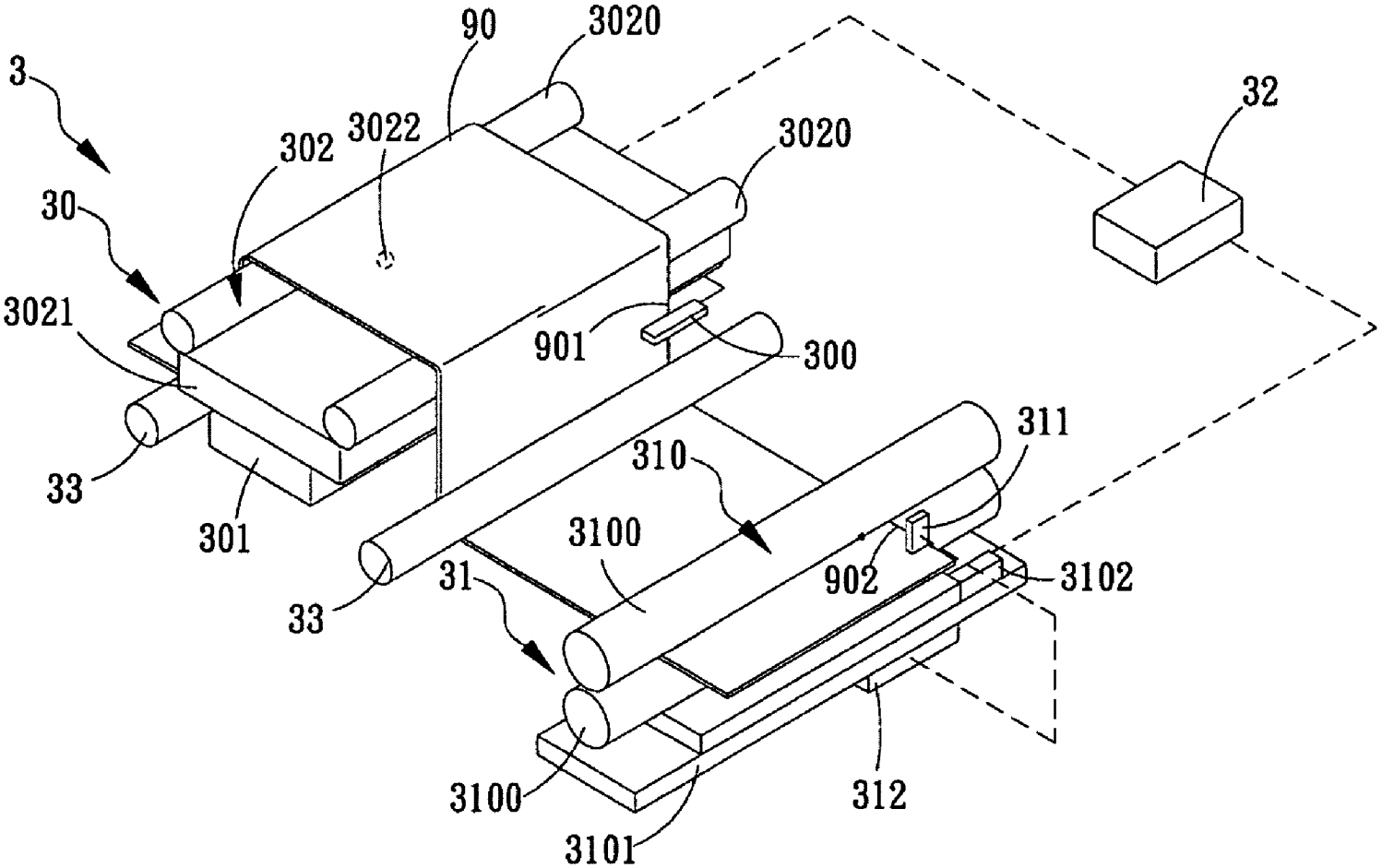
FIG. 5 is a schematic view of a web transportation guiding apparatus according to a first embodiment of the present invention.

FIG. 5 is a schematic view of a first embodiment of a web transportation guiding apparatus of the present invention. Referring to FIG. 5, in this embodiment, the web transportation guiding apparatus 3 includes a coarse position guiding module 30, a fine position guiding module 31, and a control module 32. The apparatus 3 controls the coarse position guiding module 30 and the fine position guiding module 31 through the control module 32. A web 90 is transported from the coarse position guiding module 30 towards the fine position guiding module 31. Positions of specific positions on the web 90 can be individually detected through the coarse position guiding module 30 and the fine position guiding module 31 during the transportation of the web 90, so as to be used as a basis for determining a compensation of the position of the web 90, such that the web 90 is transported along preset positions. In this embodiment, the specific positions of the web 90 are, but not limited to, side edges 901 and 902.

The coarse position guiding module 30 having an adjustment precision approximately in a range of hundreds of μm includes a coarse position sensor 300, a coarse position control unit 301, and an adjustment mechanism 302. The coarse position sensor 300 is electrically connected to the coarse position control unit 301, and the coarse position control unit 301 is electrically connected to the adjustment mechanism 302 and the control module 32. The coarse position sensor 300 functions to measure a position of the side edge 901 of the web. The position value measured by the coarse position sensor 300 is returned to the coarse position control unit 301 to be analyzed. When determining that a shift occurs to the side edge 901 of the web 90, the coarse position control unit 301 may control the adjustment mechanism 302 to compensate the shift of the web 90 in real time. The adjustment mechanism 302 may adjust the position of the side edge of the web 90 in a manner of a linear displacement motion or a swing motion. In this embodiment, the adjustment motion is the swing motion.

The adjustment mechanism 302 further has a pair of rollers 3020 and a linear moving platform 3021. The pair of rollers 3020 has a pivot point 3022. The linear moving platform 3021 is connected to the pair of rollers 3020. The linear moving platform 3021 swings the pair of rollers 3020 about the pivot point 3022 according to the coarse position control signal, thereby driving the web 90 to swing left and right, so as to achieve the edge tracing guiding effect. In addition, a roller 33 is used to change a traveling height of the web 90, such that the web 90 can pass by the pair of rollers 3020 during the transportation. The adjustment mechanism 302 belongs to the prior art and will not be repeated herein. Another kind of adjustment mechanism adjusts the position of the web in a manner of translational motion.

As shown in FIG. 5, the fine position guiding module 31 having a control precision in a range of tens of μm includes an adjustment mechanism 310, a fine position sensor 311, and a fine position control unit 312. A position value measured by the fine position sensor 311 is returned to the fine position control unit 312 to be analyzed. When determining that a shift occurs to the side edge 902 of the web 90, the fine position control unit 312 may control the adjustment mechanism 310 to compensate the shift of the web 90 in real time. The fine position guiding module 31 may be regarded to have the fine positioning function. The fine position guiding module 31 employs a lateral translation-type edge tracing manner, and the adjustment mechanism 310 thereof may perform the translation-type edge tracing guidance on the web in a clamping, adsorption, or friction manner. In this embodiment, the adjustment mechanism 310 is a translation-type clamping mechanism which may perform a linear displacement movement to adjust the position of the web 90. In this embodiment, the adjustment mechanism 310 has a pair of rollers 3100 and a linear moving platform 3101. The pair of rollers 3100 may be provided for clamping the web 90. The linear moving platform 3101 is coupled to the pair of rollers 3100, and drives the pair of rollers 3100 to generate a linear displacement motion according to the fine position control signal, thereby adjusting the position of the web.

In addition, the adjustment mechanism 310 further has an encoder 3102 electrically connected to the control module 32. The encoder 3102 may return an absolute position of the linear moving platform 3101 of the adjustment mechanism 310 to the control module 32, such that the control module 32 gets to know a position status of the adjustment mechanism 310 at any time. The type and principle of the encoder 3102 belong to the prior art and will not be repeated herein. When the control module 32 confirms that the position about the adjustment mechanism 310 returned by the encoder 3102 is about to reach a limit point of a certain edge according to the position, the control module 32 transfers a control instruction to the coarse position control unit 301, and the coarse position control unit 301 changes an edge tracing reference position of the coarse position guiding module 30 according to the content of the control instruction. In addition, although the above control module 32, coarse position control unit 301, and fine position control unit 312 are separated from each other in the implementation, they can be integrated by those skilled in the art to similarly achieve the specific effect of the present invention. The control module 32 may be, but not limited to, various processors such as a computer, a control chip IC, or a programmable logic controller (PLC).

Figure 6:
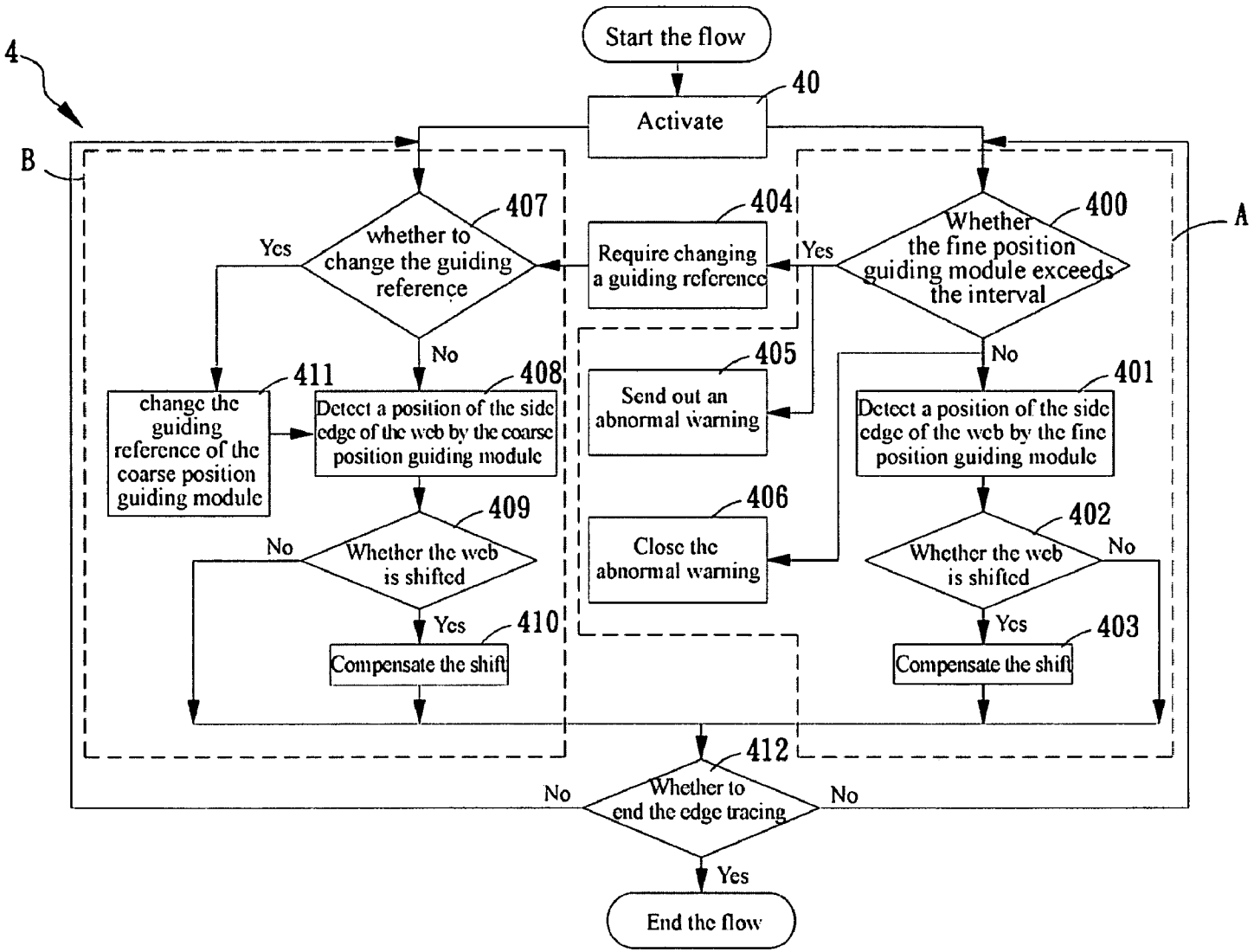
FIG. 6 is a schematic flow chart of processes of a web transportation guiding method according to the present invention.
Figure 7:
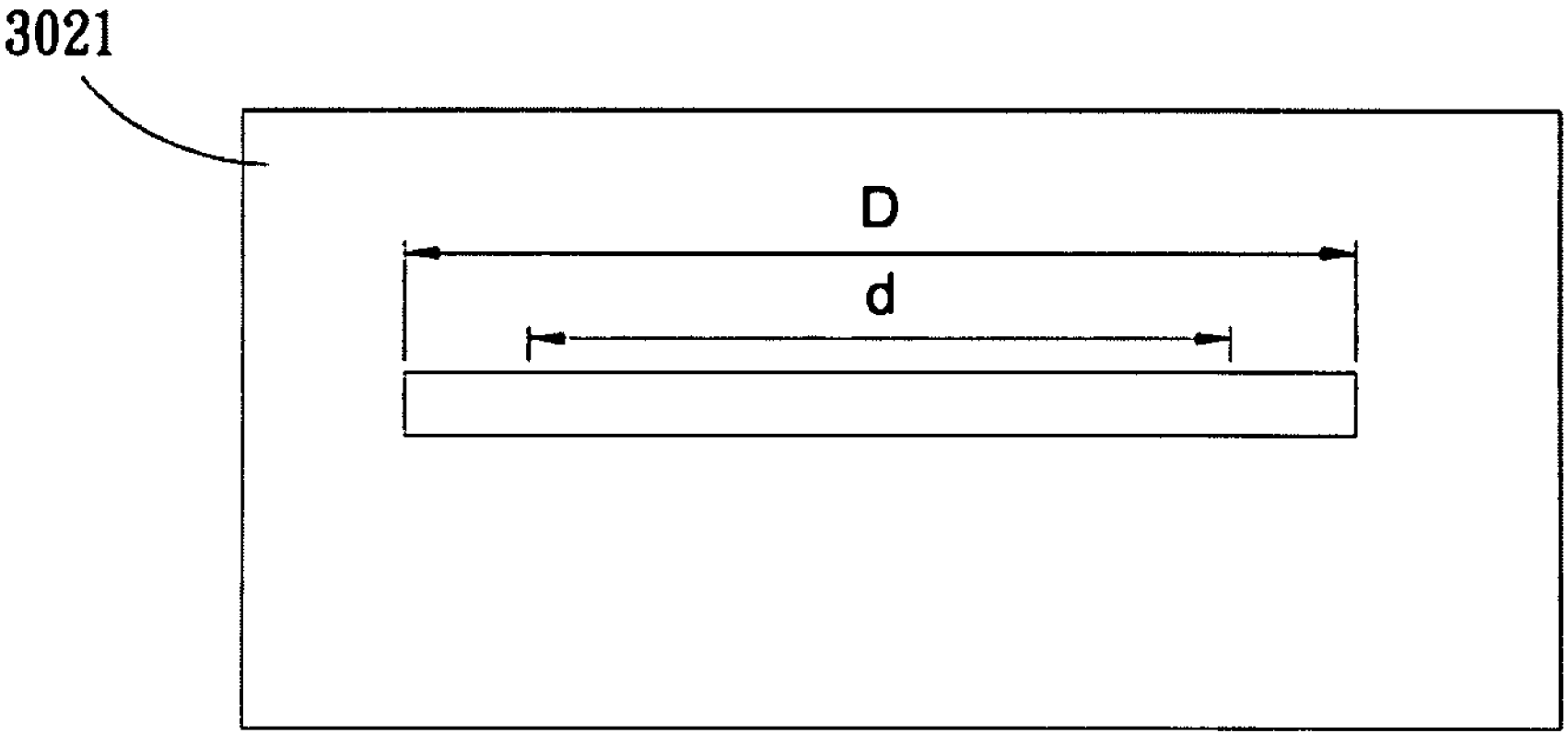
FIG. 7 is a schematic view illustrating a moving travel of an adjustment mechanism of a fine position guiding module in FIG. 5.

Referring to FIGS. 5 and 6, FIG. 6 is a schematic flow chart of processes of a web transportation guiding method according to the present invention. In this embodiment, the guiding method 4 includes control rules of the coarse position guiding module 30 and the fine position guiding module 31. A block B is the control rule of the coarse position guiding module 30, and a block A is the control rule of the fine position guiding module 31. In Step 40, the control rules of the coarse position guiding module 30 and the fine position guiding module 31 may be activated simultaneously, or the control rule of the coarse position guiding module 30 or the control rule of the fine position guiding module 31 may be activated alone. In Step 400, it is first determined whether the fine position guiding module 31 approaches a moving limit of the adjustment structure. FIG. 7 is a schematic view illustrating a moving travel of the adjustment mechanism of the fine position guiding module 31 in FIG. 5. In FIG. 7, D represents a linear movement range of the linear moving platform 3101 of the entire adjustment mechanism. In order to prevent the adjustment mechanism from moving to limits, i.e., two ends of D when compensating the web position, the present invention defines a movement interval d as a reference of safe movement, that is, uses regional ranges between boundaries of the movement interval d and boundaries of the linear movement range D as a basis for determining whether the fine position guiding module approaches the limit of the moving travel. The size of the regional ranges between the boundaries of the movement interval d and the boundaries of the linear movement range D may depend on demands and is not limited. Referring to FIGS. 5 and 6 again, in Step 400, it is determined whether the adjustment mechanism 310 moves beyond the range of the movement interval d. If a position of the linear moving platform 3101 of the fine position guiding module 31 is still a distance from the limit point, the flow proceeds to Step 401 in which the fine position sensor 311 is used to measure a position of the side edge 902 of the web 90. In Step 402, it is determined whether a shift occurs to the web 90. If a shift occurs, the flow proceeds to Step 403 in which the fine position guiding module 31 is driven to compensate the shift of the web 90. Then, the flow returns to Step 400 through Step 412, and is executed repeatedly.

Figure 8:
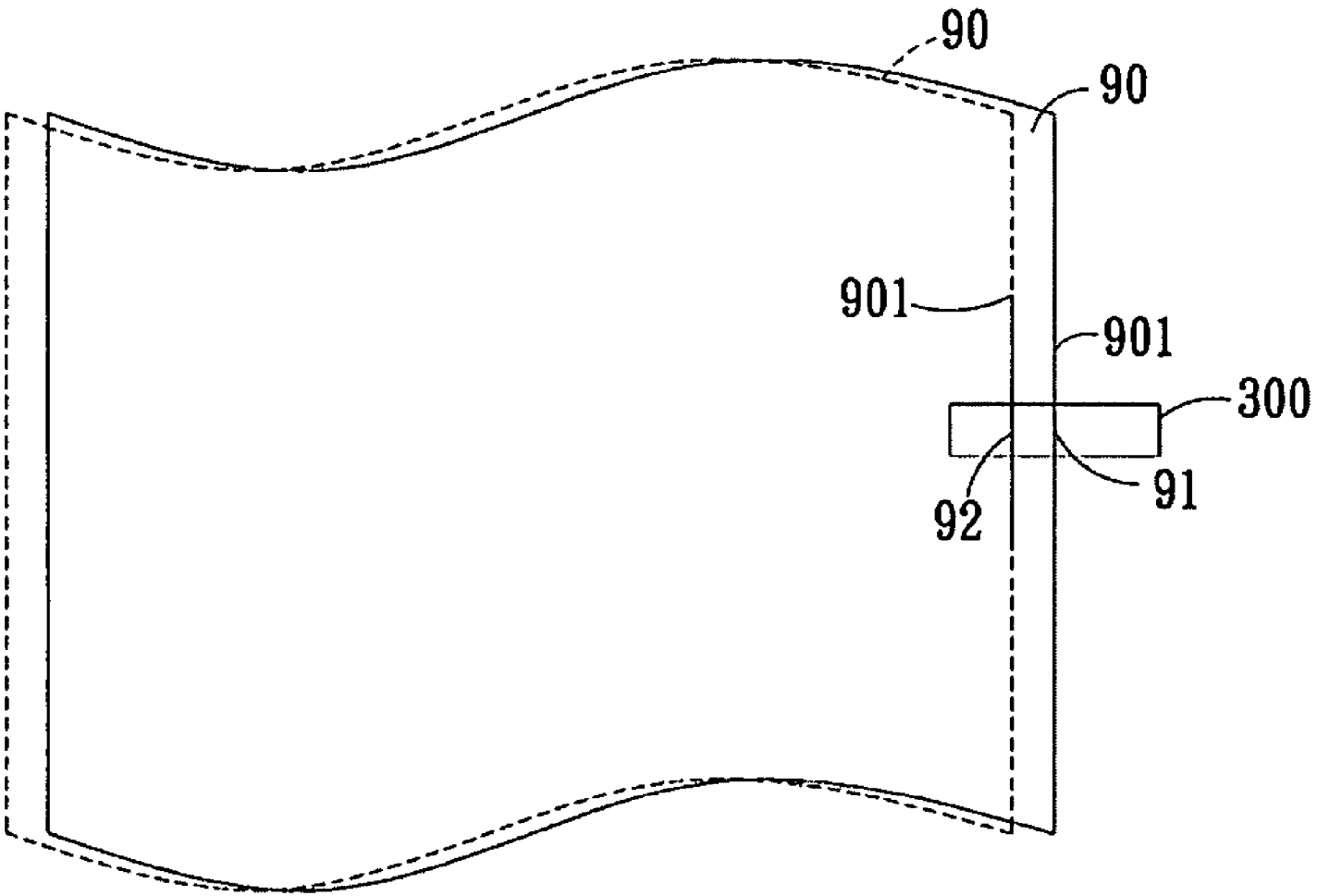
FIG. 8 is a schematic view illustrating a parameter changed reference.

After a series of repeated executions of Steps 400-403, if in Step 400 it is first determined that the fine position guiding module 31 has approached the travel limit point, i.e., exceeded the range of the movement interval d U.S. Pat. No. 4,958,111 and U.S. Pat. No. 4,453,659 in FIG. 7, the flow proceeds to Step 404 of sending out a signal to change an edge tracing reference of the coarse position guiding module 30, and to Step 405 of sending out an abnormal warning. The block B is the control rule of the coarse position guiding module, in which a coarse edge tracing work on the web may be performed independently. First, in Step 407, it is detected whether a trigger signal from Step 404 exists. Once the signal of Step 404 is received in Step 407, the flow proceeds to Step 411 to change the edge tracing reference of the coarse position guiding module 30. The edge tracing reference of the coarse position guiding module may be changed by moving the position of the coarse position sensor 300 or by setting a parameter, but not limited thereto. FIG. 8 is a schematic view illustrating a parameter changed reference. Before the reference is changed by the use of a parameter, it is determined that a reference position 91 of a side edge shift of the web is at a center of the coarse position sensor 300, i.e., a zero point. However, if the reference for determination is to be changed by the use of the parameter, the change may be made in a software manner to move the position of the zero point to the left or to the right since the position of the coarse position sensor 300 is not changed. In FIG. 8, the position of the zero point is moved to the left to the position of a label 92. That is, if the reference is changed to the position 92, the side edge of the web 90 is determined as shifted if not at the position of 92.

Referring to FIGS. 5 and 6 again, the flow immediately proceeds to Step 408 to measure the edge position of the web. Then, in Step 409, it is determined whether a shift occurs to the web according to a new edge tracing reference changed in Step 411. Afterwards, the coarse position guiding module 30 is driven to compensate the shift of the web 90 in Step 410. After that, the flow returns to Step 407 again to perform an edge tracing guidance. The above illustrates the flow of the edge tracing guidance performed in the block B after the signal of Step 404 is received. When the edge tracing reference of the coarse position guiding module needs not to be changed in a normal situation, the flow directly proceeds from Step 407 to Step 408 to measure the side edge position of the web 90. Afterwards, in Step 409, it is determined whether a shift occurs to the web 90 according to an edge tracing reference that is set finally. Then, the coarse position guiding module 30 is driven to compensate the shift of the web 90 in Step 410. In Step 412, it is determined whether to stop the edge tracing on the web 90. If the user requires stopping the edge tracing operation on the web 90, the flow of the web transportation guiding method 4 is ended. The specific efficacy of the present invention for preventing from moving to the limit can be realized by Step 411 in the web transportation guiding method 4, because the problem that the fine position guiding module reaches the limit point can be solved by changing the edge tracing reference of the coarse position guiding module. In addition, the steps other than Step 411 in the flow of the web transportation guiding method can be deleted or changed randomly in sequence upon demands.

Although the pure usage of a translation-type guiding module for performing the edge tracing guidance on the web can obtain a higher edge tracing precision than the usage of a swing-type guiding module alone, after the translation-type guiding module is used alone for a period of time, a limit point of a certain edge may be reached and the edge tracing cannot be continued, and a time point at which the situation occurs cannot be predicted. This is usually associated with an edge roughness when the web is unwound or a parallelism of rollers of the equipment. Especially when the parallelism of the rollers is undesirable, the web always tends to shift in a fixed direction, and the translation-type guiding module soon reaches a limit point of a certain edge under the effect of a recovery of the web in order to compensate the shift of the web.

Figure 9B:
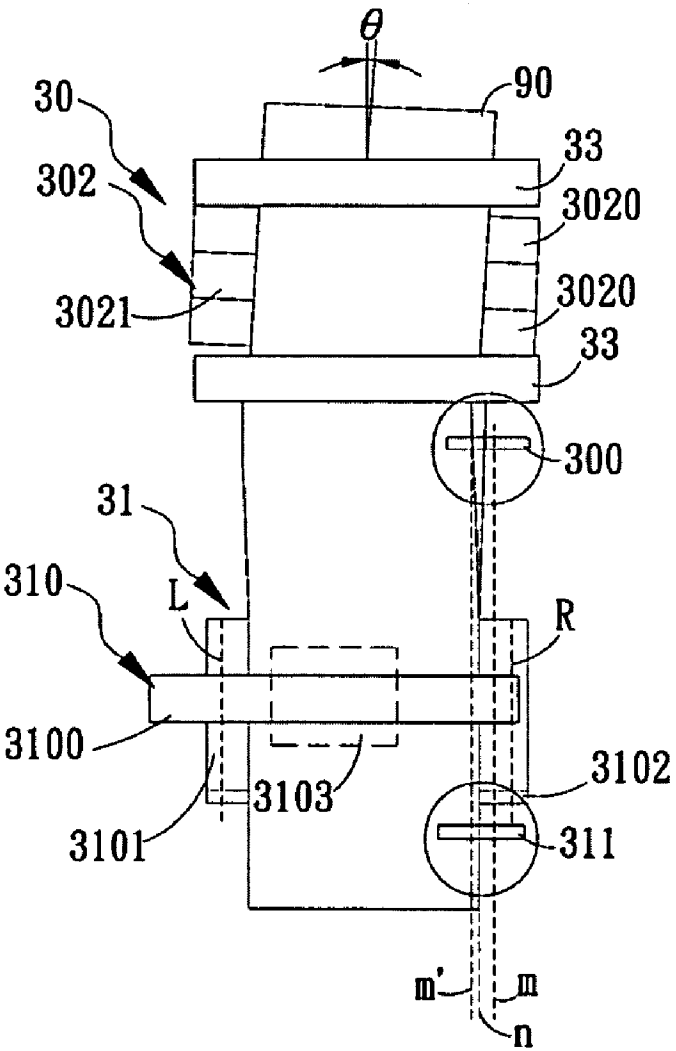
FIGS. 9A and 9B are top views illustrating an operation of the web transportation guiding apparatus according to the first embodiment of the present invention.
Figure 9A:
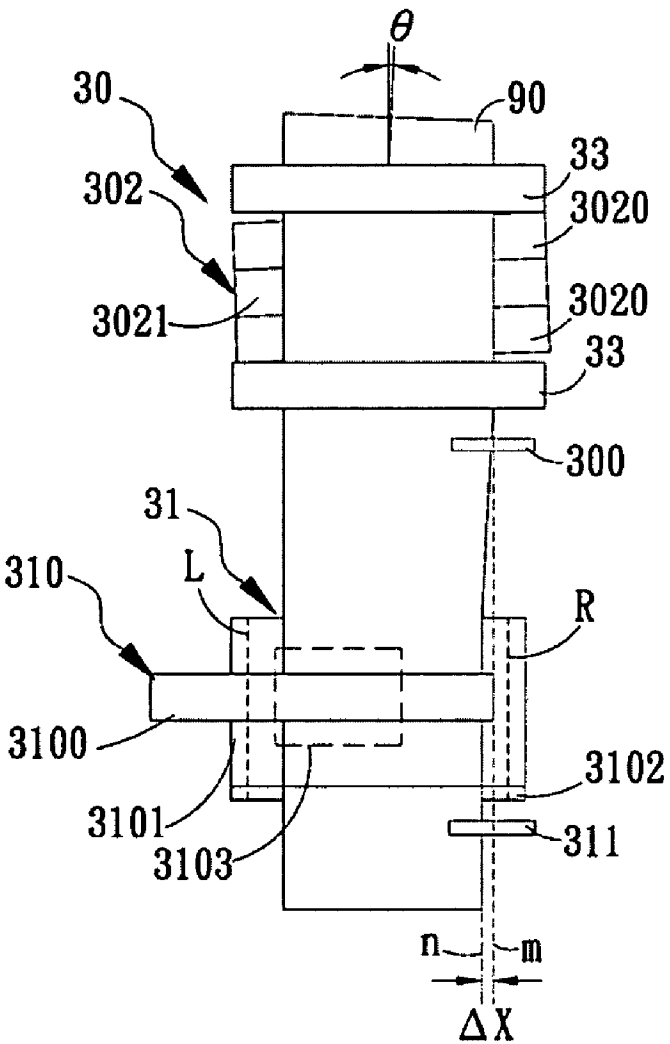

FIGS. 9A and 9B are top views illustrating an operation of the web transportation guiding apparatus according to the first embodiment of the present invention. Whether the linear moving platform exceeds limit points R (a right limit) and L (a left limit) of the movement interval d can be effectively grasped through the encoder 3102. Taking FIG. 9 as an example, since the linear moving platform 3101 is connected to the roller 3100 by a platform 3103, the platform 3103 is driven by the linear moving platform 3101 to move on a track of the linear moving platform 3101, thereby driving the roller 3100 to move. When the platform 3103 is moved to reach the travel limit point L of the linear moving platform 3101, it indicates that the coarse position guiding module 30 always transports the web 90 in a certain direction. Therefore, after the web 90 enters into the fine position guiding module 31, the fine position guiding module 31 must continuously guide the web 90 in the same direction, such that finally the platform 3103 gradually approaches the travel limit point L. Currently, the common equipment cannot effectively ensure that the web remains perpendicular to the rollers during the actual web transportation. Therefore, when the web 90 enters into the coarse position guiding module 30, an angle difference θ exists between the web 90 and the roller 33, and the sensor 300 of the coarse position guiding module 30 may measure a position of the edge of the web 90. Once a shift generated by the edge of the web 90 is found, the roller 3020 is driven to swing by the linear moving platform 3021 to compensate the shift, such that the edge of the web 90 can be effectively maintained at a position of an edge tracing reference m of the coarse position guiding module 30. After the web 90 passes through the coarse position guiding module 30, a coarse positioning of the web 90 can be regarded as completed. The web 90 subsequently enters into the fine position guiding module 31. The fine position guiding module 31 used in the first embodiment employs the translation-type edge tracing manner. In this manner, the sensor 311 of the fine position guiding module 31 may measure a position of the web edge. Once a shift generated by the web edge is found, the roller 3100 is driven to translate by the linear moving platform 3101 to compensate the shift, such that the web edge can be effectively maintained at a position of an edge tracing reference n of the fine position guiding module 31.

It can be found from FIG. 9A that an error ΔX exists between the edge tracing reference n of the fine position guiding module 31 and the edge tracing reference m of the coarse position guiding module 30, because human errors or errors in mechanism assembly are difficult to avoid when the sensors 300 and 311 are erected. Therefore, no error exists between the edge tracing references n and m cannot be effectively determined, and because of the existence of the error ΔX, the fine position guiding module 31 reaches the limit of a certain edge after operating for a period of time. In FIG. 9A, for example, an edge of the platform 3103 of the linear moving platform 3101 reaches the left limit L, and the linear moving platform 3101 has an insufficient travel to continue performing the edge tracing guidance to the left. Since the coarse position guiding module 30 controls the web edge at the position of the edge tracing reference m but the fine position guiding module 31 needs to control the web edge at the position of the edge tracing reference n, the linear moving platform 3101 should drive the roller 3100 to translate so as to compensate the shift ΔX, such that the position of the web edge is compensated from m to n. Since the fine position guiding module 31 must compensate the shift ΔX continually, and meanwhile the web 90 is subjected to a recovery force and generates a recovery, finally the edge of the platform 3103 of the linear moving platform 3101 is moved to the left limit L under repeated actions of the compensation of the shift ΔX and the recovery.

Therefore, in an algorithm of the present invention, when the linear moving platform 3101 reaches or approaches the left limit L, a signal is sent to the coarse position guiding module 30 to require changing the edge tracing reference m of the coarse position guiding module 30, such that the linear moving platform 3101 of the fine position guiding module 31 may have sufficient travel to continue compensating the shift. When the edge of the platform 3103 of the linear moving platform 3101 reaches or approaches the position of the left limit L, the algorithm of the present invention sends out the signal to the coarse position guiding module 30 and changes the edge tracing reference m of the coarse position guiding module 30. The edge tracing reference m of the coarse position guiding module 30 is modified intentionally with the wish that the linear moving platform can be moved in a direction away from the limit point L so as to return to the center of the travel by changing the position where the web 90 enters into the fine position guiding module 31. In addition, when the platform 3103 of the linear moving platform 3101 reaches or approaches the position of the right limit R, the algorithm similarly sends out a signal to the coarse position guiding module 30 and changes the reference.

Figure 10B:
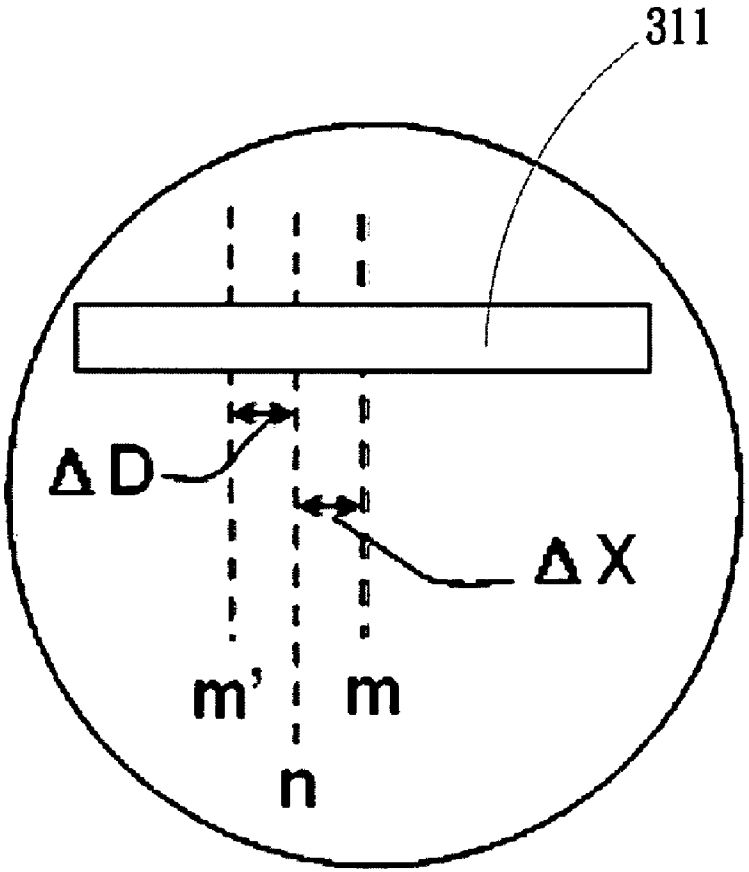
FIGS. 10A and 10B are schematic enlarged views of a coarse position sensor and a fine position sensor of the web transportation guiding apparatus according to the first embodiment of the present invention.
Figure 10A:
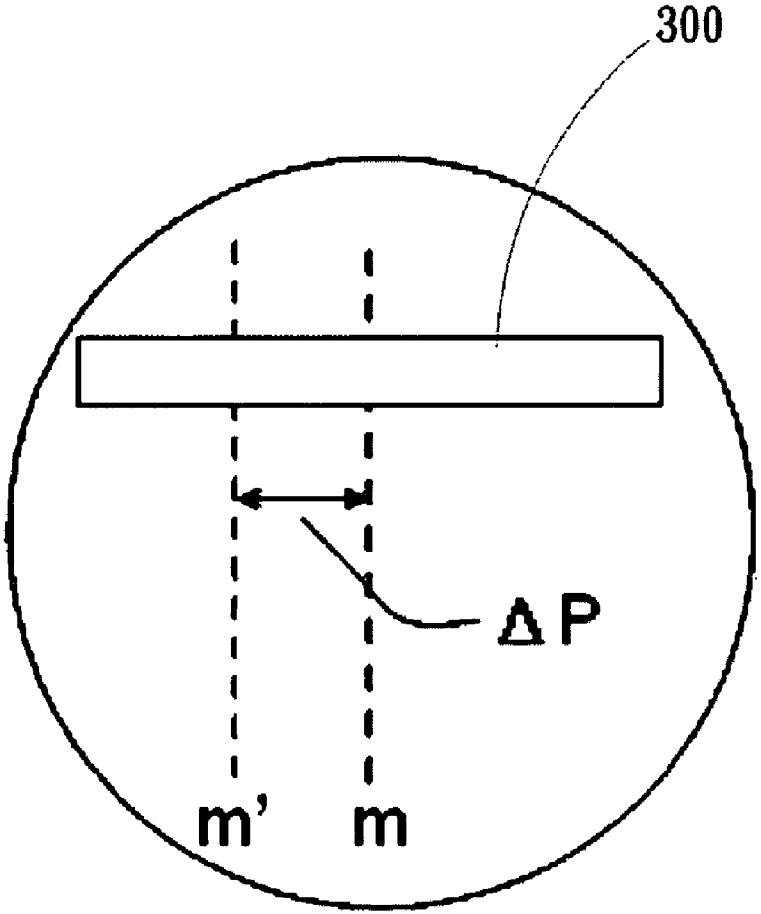

How the novel solution solves the problem that the translation-type guiding module reaches the limit point by changing the edge tracing reference position of the swing-type guiding module will be illustrated below. As shown in FIG. 9B, with the procedure in FIG. 6, when it is found that the limit L is to be exceeded, a signal is sent out to the coarse position guiding module 30 to require changing the edge tracing reference m of the coarse position guiding module 30. At this time, the edge tracing reference of the coarse position guiding module 30 is changed from m to m'. FIG. 10A is a partial enlarged view of the edge tracing reference of the coarse position guiding module 30, as shown in the figure, it can be found that the edge tracing reference m' after the change is spaced at a distance of ΔP from the edge tracing reference m before the change. The distance of ΔP may be achieved by moving the position of the sensor or changing internal settings of the algorithm as described above, and will not be repeated herein. FIG. 10B is a partial enlarged view of the edge tracing reference of the fine position guiding module 31, as shown in the figure, originally an error ΔX exists between the edge tracing reference m of the coarse position guiding module 30 and the edge tracing reference n of the fine position guiding module 31, the edge tracing reference of the coarse position guiding module 30 is changed from m to m' because of a variation of the distance ΔP generated by the change of the edge tracing reference, and ΔP≧ΔX. Therefore, a new error ΔD is generated between the edge tracing reference m' of the coarse position guiding module 30 and the edge tracing reference n of the fine position guiding module 31. Because of the new error ΔD between the edge tracing references of the coarse position guiding module 30 and the fine position guiding module 31, the problem that the edge of the platform 3103 of the linear moving platform 3101 shifts towards the left limit L can be solved exactly through the error ΔD. Since the fine position guiding module 31 finds that the coarse position guiding module 30 controls the web edge at the position of the edge tracing reference m' but the fine position guiding module 31 needs to control the web edge at the position of the edge tracing reference n, the linear moving platform 3101 should drive the roller 3100 to translate so as to compensate the shift ΔD, such that the position of the web edge is compensated from m' to n. Since the fine position guiding module 31 must compensate the shift ΔD continually, and meanwhile the web 90 is subjected to a recovery force and generates a recovery, finally the edge of the platform 3103 of the linear moving platform 3101 is away from the left limit L under repeated actions of the compensation of the shift ΔD and the recovery, and the problem that the translation-type guiding module reaches the limit point is effectively solved.

Figure 11:
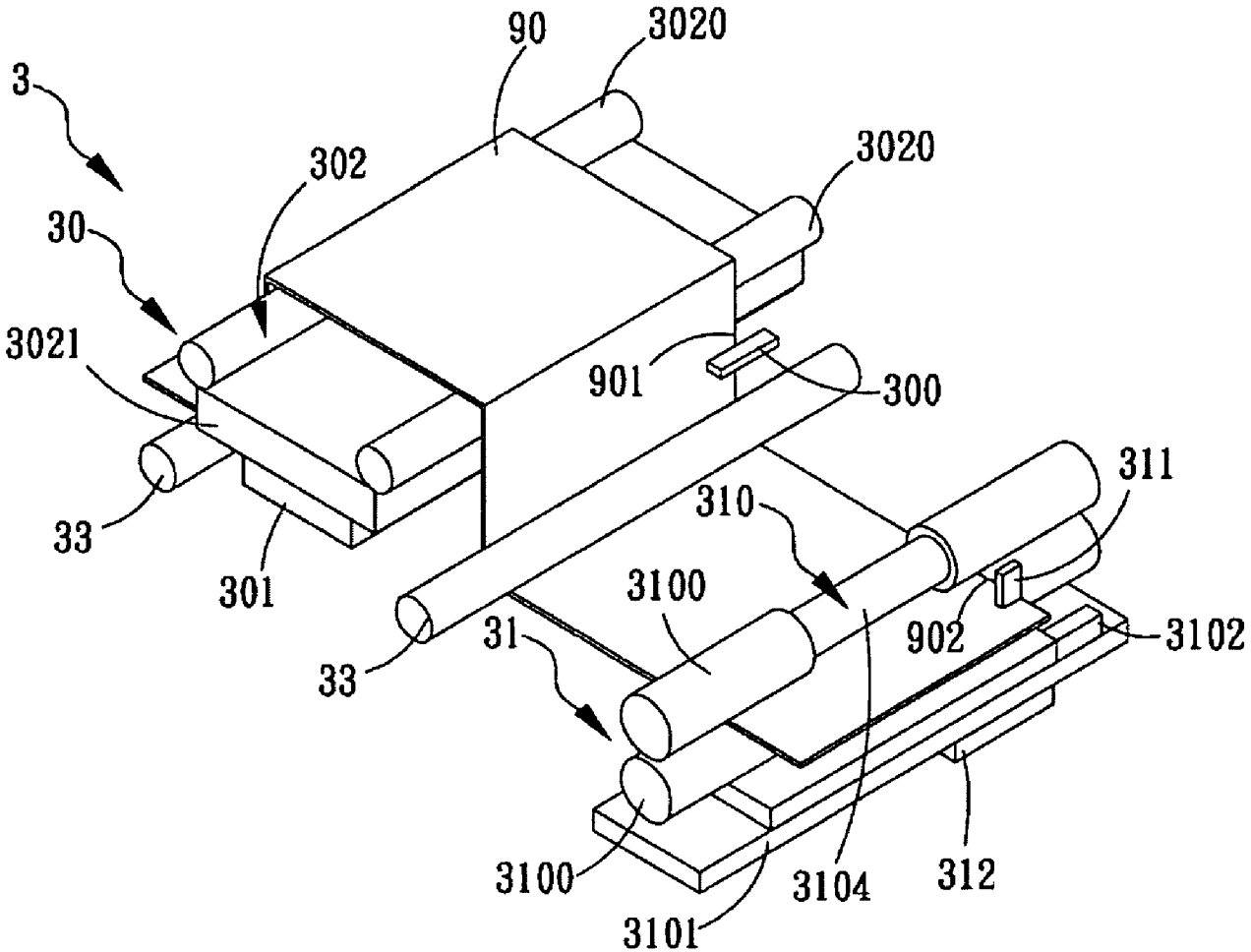
FIG. 11 is a schematic view of a web transportation guiding apparatus according to a second embodiment of the present invention.

FIG. 11 is a schematic view of the web transportation guiding apparatus according to a second embodiment of the present invention. This embodiment is basically the same as the embodiment in FIG. 5. The difference lies in that the roller 3100 in the upper side of the adjustment structure 310 of the fine position guiding module 31 has a recess 3104. Since a circuit or pattern may be formed on the web surface due to a process, and the upper roller tends to crush the process pattern or circuit on the web surface in the manner of FIG. 5, a replacement with the roller 3100 having the recess 3104 may avoid the damage to the web surface. The implementation and control method of the embodiment in FIG. 11 is as described above and will not be repeated herein.

Figure 12A:
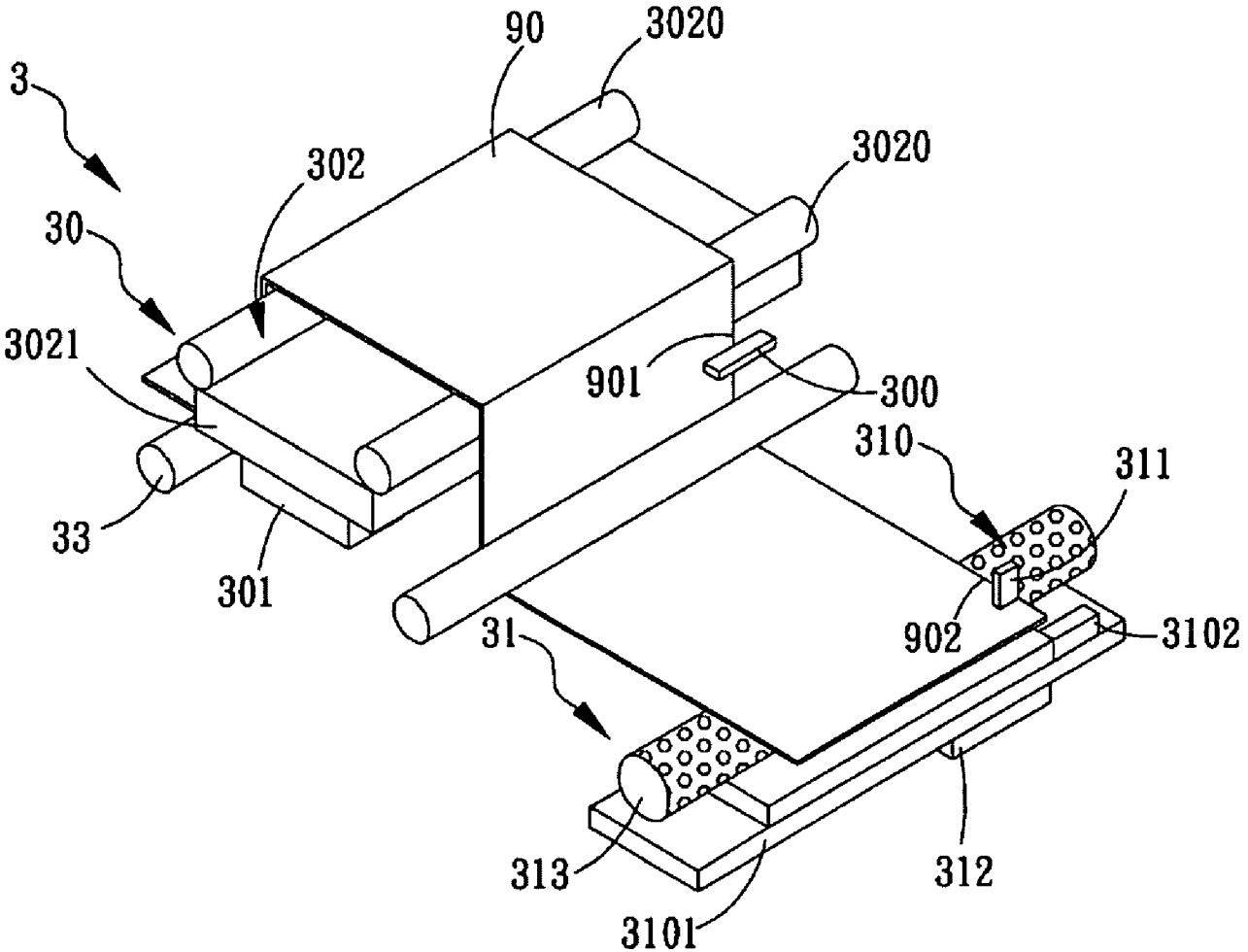
FIG. 12A is a schematic view of a web transportation guiding apparatus according to a third embodiment of the present invention.
Figure 12B:
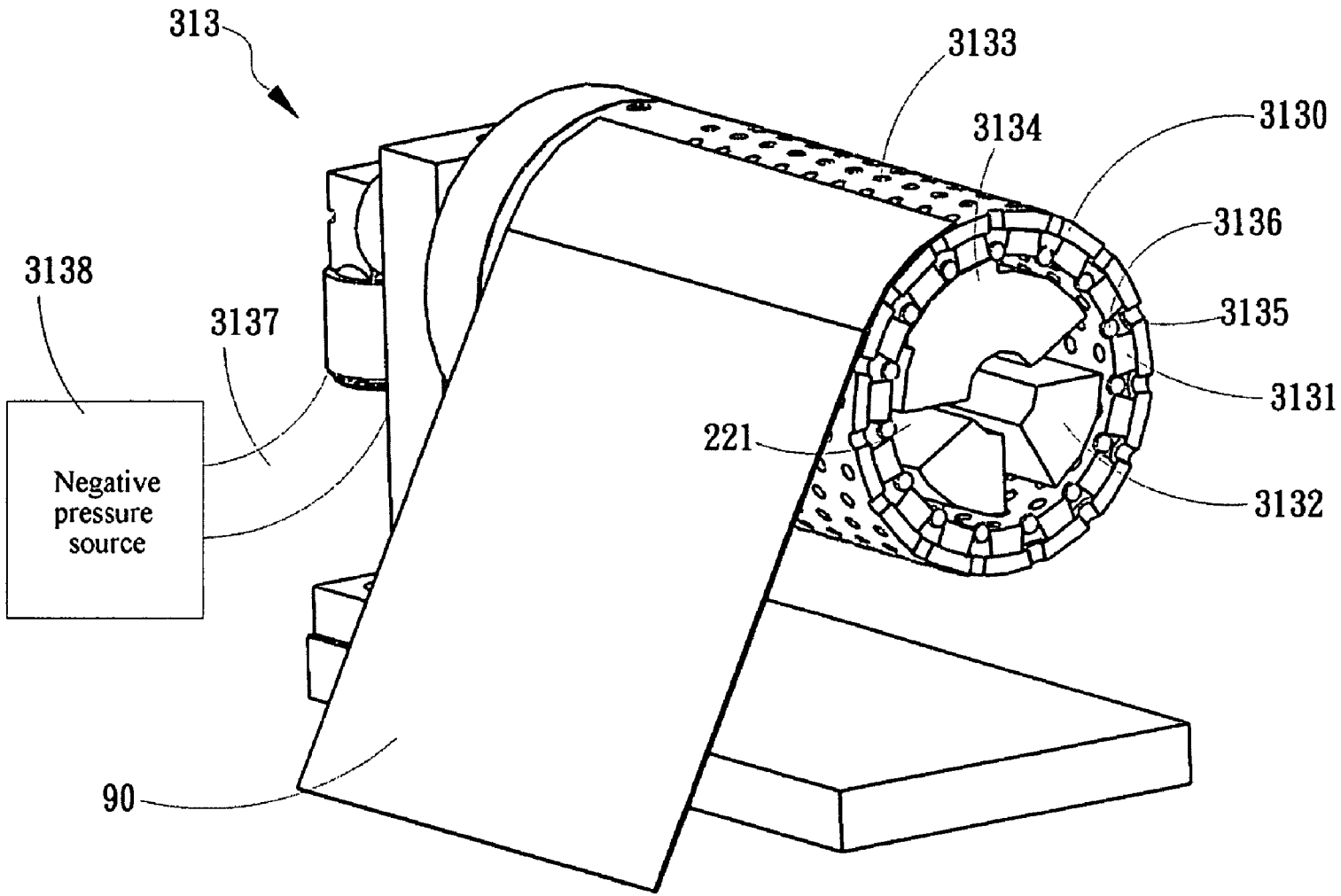
FIG. 12B is a schematic structural view of a suction roller of the present invention.
Figure 13B:
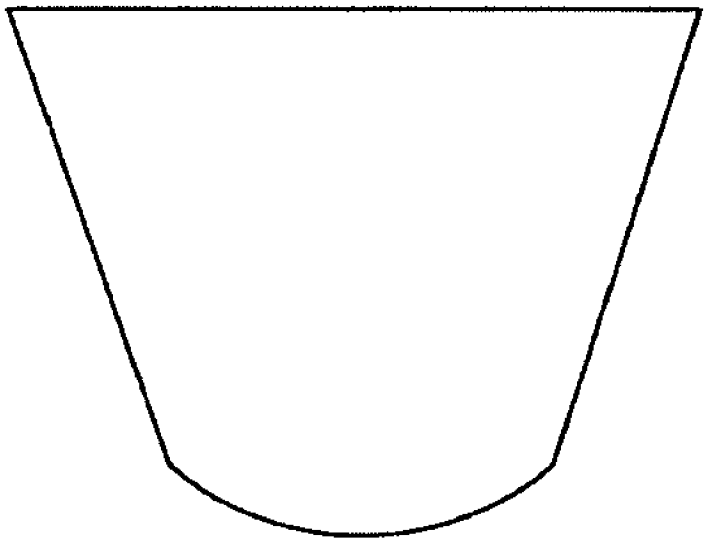
FIGS. 13A to 13D are schematic views of a valve of the present invention.
Figure 13A:
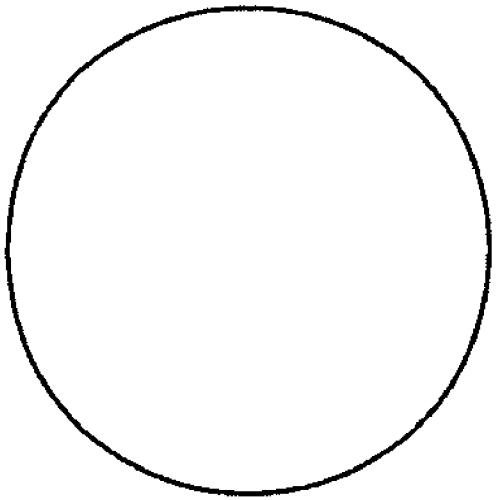
Figure 13D:
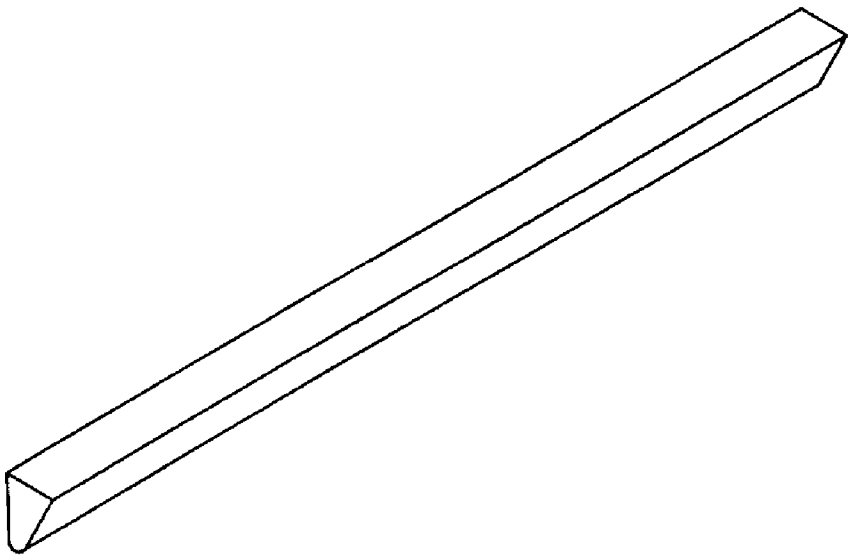
Figure 13C:
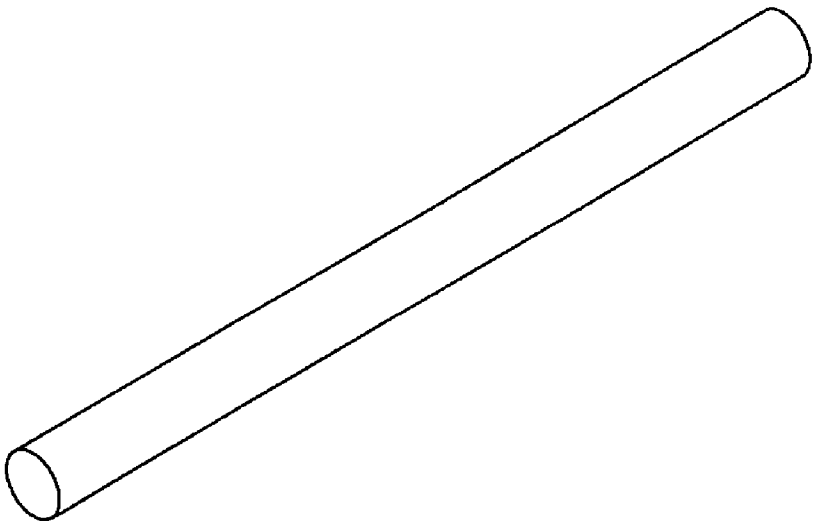

FIG. 12A is a schematic view of the web transportation guiding apparatus according to a third embodiment of the present invention. This embodiment is basically the same as that in FIG. 5. The difference lies in that the fine position guiding module uses a suction roller 313 to replace the roller set clamping the web 90 with a vacuum adsorption manner, and controls the position of the web 90 by adjusting a left and right position of the suction roller 313. This is because the left and right deviation position of the web 90 can be adjusted upon an adsorption of the web 90 by the suction roller 313, and the web 90 keeps its position never changed under a suction force. FIG. 12B is a schematic structural view of the suction roller according to the present invention. In this embodiment, the suction roller 313 has an outer sleeve 3130, an outer roller 3131, and an inner roller 3132. The outer sleeve 3130 has a plurality of first through holes 3133. A material of the outer sleeve 3130 is one selected from among steel, glass, ceramic, fiber, and plastic materials. The outer roller 3131 is accommodated in the outer sleeve 3130 and has a plurality of second through holes 3135 corresponding to the plurality of first through holes 3133. Each of the second through holes 3135 is provided for accommodating a valve 3136. In this embodiment, the second through hole 3135 is a conical hole. In order to prevent the valve 3136 from dropping off the first through hole 3133 when the outer roller 3131 is rotated to a specific position, an aperture of the first through hole 3133 is smaller than the outermost aperture of the second through hole 3135. FIGS. 13A to 13D are schematic views of the valve according to the present invention. In order to match with the second through hole 3135, the valve 3136 may be a sphere shown in FIG. 13A or a cone shown in FIG. 13B. Furthermore, the valve 3136 may also be long strip shaped, for example, a circular cylinder in FIG. 13C or a cone cylinder in FIG. 13D. It is understood that if the valve 3136 is cylindrical shaped, the second through hole 3135 is also an elongated hole matching therewith. A material of the valve 3136 is one selected from among steel, glass, ceramic, fiber, and plastic materials. The suction roller 313 may be connected to a negative pressure source 3138 through pipe lines 3137 at one side thereof. The negative pressure source 3138 provides a negative pressure, such that the suction roller 313 generates a suction force to adsorb the web 90.

Figure 14A:
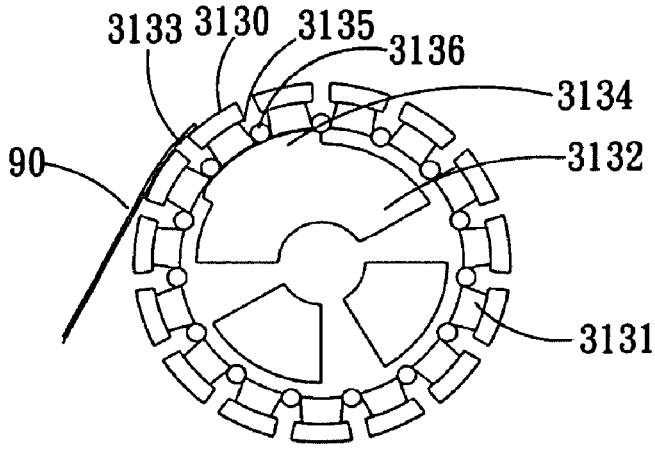
FIGS. 14A to 14C are schematic views illustrating that the suction roller of the present invention transports an object.
Figure 14B:
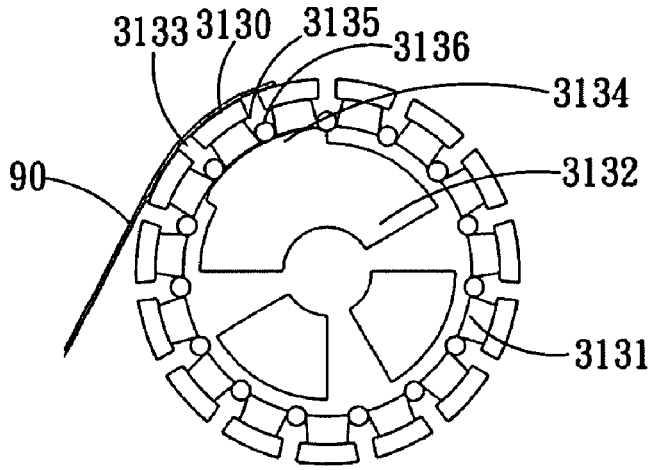
Figure 14C:
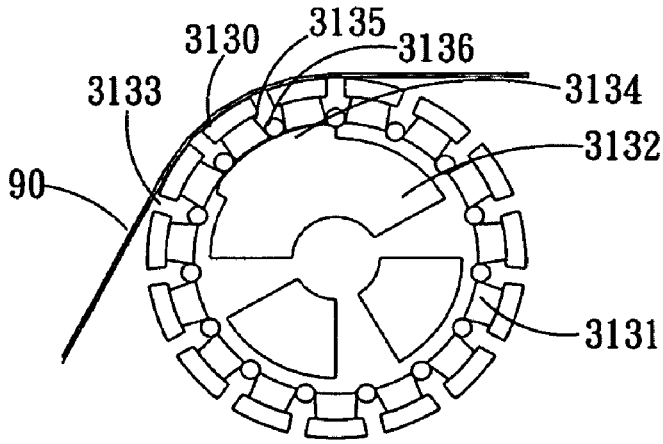

FIGS. 14A to 14C are schematic views illustrating that the suction roller of the present invention transports an object. In FIG. 14A, the web 90 is adsorbed upon contacting the surface of the outer sleeve 3130. Because the valve 3136 contacting a convex portion 3134 of the inner roller 3132 is pressed open by the inner roller 3132 so as not to completely close the second through hole 3135, the negative pressure may adsorb the web 90 through the first through hole 3133. As shown in FIG. 14B, when the outer sleeve 3130 is rotated, the valve 3136 is rotated accordingly. During the rotation of the outer sleeve 3130, the valve 3136 is pressed against the convex portion 3134 on the inner roller 3132 in turn with the rotation, so as to form a vacuum air flow gap instead of originally plugging the second through hole 3135 of the outer roller 3131 to generate a vacuum adsorption to directly adsorb the web 90 and transport the web 90. When a position of the suction roller 313 is adjusted left and right, the web 90 is pulled to move left and right and keeps its position never changed under a suction force. As shown in FIG. 14C, after departing from the convex portion 3134, the rotated valve 3136 is sucked again by the negative pressure passing through the second through hole 3135 to plug the second through hole 3135, so as to close the vacuum air flow gap. At this time, the web 90 is released without the vacuum air flow adsorption. Through the rotation of the suction roller 313, the valves 3136 above the convex portion 3134 tightly adsorb the web 90 by the vacuum air, and the valves 3136 in regions (the regions that the convex portion 3134 is not pressed against) where the web 90 is not adsorbed plug the second through holes 3135 of the outer roller 3131, so as to transport the web 90 forward gradually.

Figure 15:
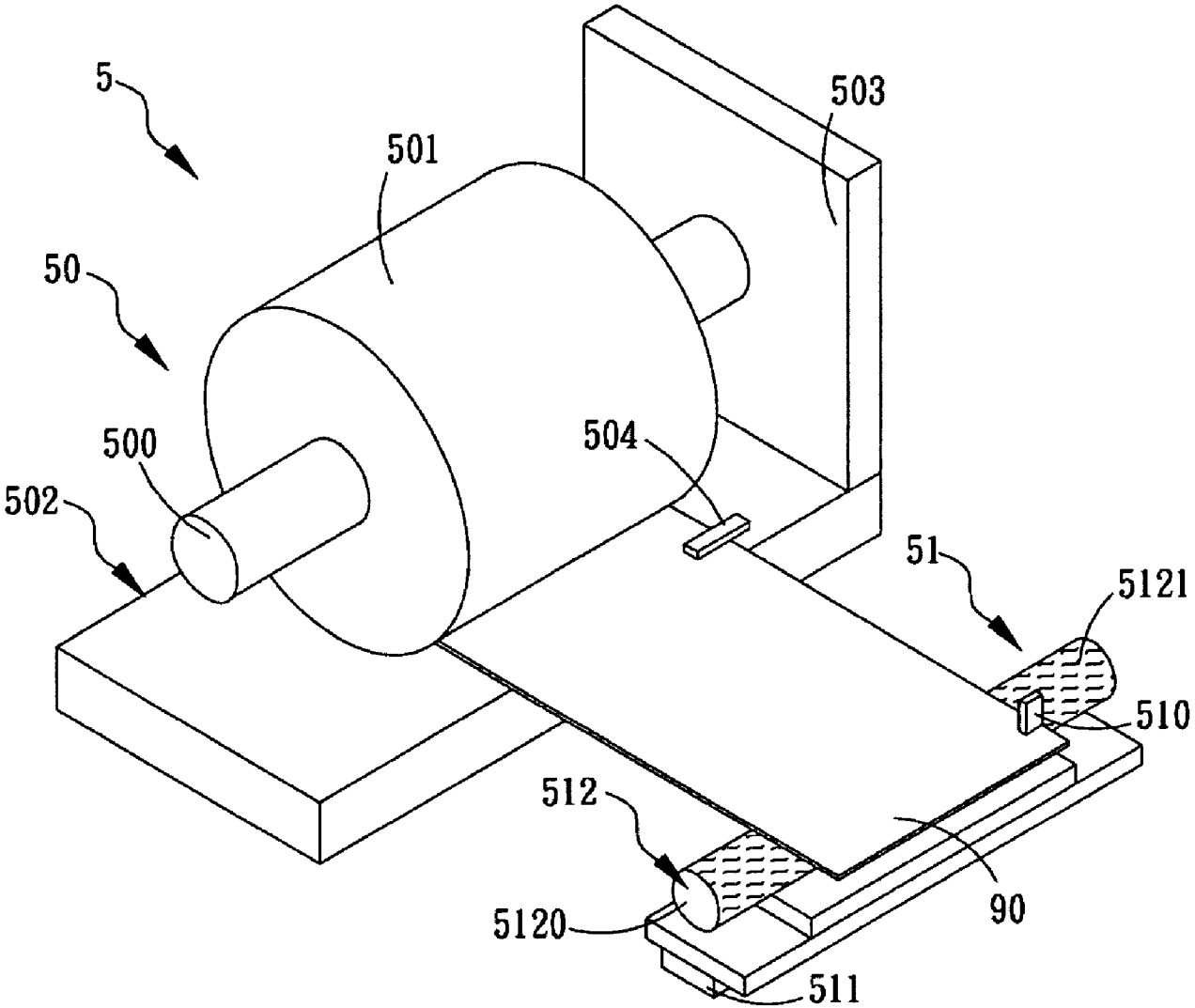
FIG. 15 is a schematic view of a web transportation guiding apparatus according to a fourth embodiment of the present invention.

FIG. 15 is a schematic view of the web transportation guiding apparatus according to a fourth embodiment of the present invention. In this embodiment, the web transportation guiding apparatus 5 includes a coarse position guiding module 50 and a fine position guiding module 51. The fine position guiding module 51 employs a lateral translation-type edge tracing manner to perform a translation-type edge tracing guidance on the web 90 in a friction manner. The fine position guiding module 51 has a fine position sensor 510, a fine position control module 511, and an adjustment mechanism 512. Functions and structures of the fine position sensor 510 and the fine position control module 511 are the same as those described above and will not be repeated herein. The adjustment mechanism 512 has a friction roller 5120 having a rough surface structure 5121 through which the friction roller 5120 have friction with the web 90. A position of a side edge of the web 90 is measured by the fine position sensor 510. Once a shift generated by the side edge of the web 90 is found, a linear moving platform 5122 connected to the friction roller 5120 moves the friction roller 5120. At this time, the friction roller 5120 may have friction with the web 90 and drive the web 90 to move, so as to guide the shift of the web. A structure of the linear moving platform 5122 is as described above and will not be repeated herein.

Furthermore, in this embodiment, the coarse position guiding module 50 is a lateral translation-type edge tracing guiding apparatus and has a rotatable roller 500. Since it is rotatable, the roller 500 can be used to carry a web roll 501 to unwind the web. In addition, the roller 500 may also wind up the web at the end of the process to form the web roll 501 in FIG. 15. The roller 500 and a linear moving platform 502 of the coarse position guiding apparatus 50 are connected to each other via a block vertical plate 503. The detailed connection manner belongs to the prior art and will not be repeated herein. A shift of the side edge of the web 90 is measured by a coarse sensor 504. The linear moving platform 502 is operated in a lateral translation manner, and thus drives the web 90 to translate left and right so as to achieve the edge tracing guiding effect. The interaction between the coarse position guiding apparatus 50 and the fine position guiding apparatus 51 may be as described according to the flow in FIG. 6 and will not be repeated herein.

The above descriptions are merely preferred embodiments of the present invention, but not intend to limit the scope of the present invention. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

To sum up, the web transportation guiding apparatus and method provided in the present invention uses the coarse guiding module in combination with the fine guiding module. The fine guiding module is capable of meeting the demand for a high-precision edge tracing, and the coarse guiding module is capable of effectively solving the problem that the translation-type fine guiding module reaches a limit point, thereby realizing the web edge tracing technology with high-precision. Therefore, the present application has been able to raise the industrial competitiveness and spur the development of peripheral industries and met the requirements for an invention application according to the provisions of the Invention Patent Law. Thus, we file the present application for a patent according to the law and would be appreciated if the Examiner examines it and grants it a patent.

What is claimed is:

1. A web transportation guiding apparatus, comprising:

a coarse position guiding module having an adjustment precision approximately in a range of hundreds of micrometers, for determining a position of a specific position on a web according to a reference, so as to compensate a shift generated by the web during a transportation;

a fine position guiding module having a control precision in a range of tens of micrometers and disposed at one side of the coarse position guiding module, for compensating the shift generated by the web during the transportation according to the position of the specific position on the web; and a control module, for determining whether to send a control instruction to the coarse position guiding module according to a position of the fine position guiding module, so as to change the reference.

2. The web transportation guiding apparatus according to claim 1, wherein the specific position is a side edge or a reference mark on a surface of the web.

3. The web transportation guiding apparatus according to claim 1, wherein the coarse position guiding module further comprises:

a coarse position sensor, for sensing the position of the specific position on the web to generate a coarse position sensing signal;

a coarse position control module, electrically connected to the coarse position sensor, for generating a coarse position control signal according to the coarse position sensing signal; and an adjustment mechanism, electrically connected to the coarse position control module, for generating an adjustment motion according to the coarse position control signal so as to adjust the position of the web.

4. The web transportation guiding apparatus according to claim 3, wherein the adjustment mechanism further comprises:

a pair of rollers, having a pivot point; and a linear moving platform, connected to the pair of rollers, for generating a linear displacement motion according to the coarse position control signal so as to rotate the pair of rollers about the pivot point.

5. The web transportation guiding apparatus according to claim 3, wherein the adjustment mechanism further comprises:

at least a roller, for supporting the web; and a linear moving platform, coupled to the at least one roller, for generating a linear displacement motion according to the coarse position control signal to make the at least one roller move.

6. The web transportation guiding apparatus according to claim 3, wherein the fine position guiding module further comprises:

a fine position sensor, for sensing the position of the specific position on the web to generate a fine position sensing signal;

a fine position control module, electrically connected to the fine position sensor, for generating a fine position control signal according to the fine position sensing signal; and an adjustment mechanism, electrically connected to the fine position control module, for generating an adjustment motion according to the fine position control signal so as to adjust the position of the web.

7. The web transportation guiding apparatus according to claim 6, wherein the adjustment mechanism further comprises:

a pair of rollers, for clamping the web; and a linear moving platform, coupled to the pair of rollers, for driving the relevant rollers to generate a linear displacement motion according to the fine position control signal.

8. The web transportation guiding apparatus according to claim 7, wherein the roller above the web further has a recess.

9. The web transportation guiding apparatus according to claim 6, wherein the adjustment mechanism further comprises:

a suction roller, disposed at a bottom of the web, for adsorbing the web by a negative pressure; and a linear moving platform, coupled to the suction roller, for driving the suction roller to generate a linear displacement motion according to the fine position control signal.

10. The web transportation guiding apparatus according to claim 9, wherein the suction roller further comprises:

an outer sleeve, having a plurality of first through holes;

an outer roller, accommodated in the outer sleeve, and having a plurality of second through holes corresponding to the plurality of first through holes, wherein each of the second through holes is provided for accommodating a valve; and an inner roller, accommodated in the outer roller, and having a convex portion and a plurality of slots, wherein the convex portion leans against an inner wall of the outer roller.

11. The web transportation guiding apparatus according to claim 6, wherein the adjustment mechanism further comprises:

a friction roller, disposed at a bottom of the web, and having patterns on a surface thereof so as to lean against the web; and a linear moving platform, coupled to the friction roller, for driving the friction roller to generate a linear displacement motion according to the fine position control signal.

12. The web transportation guiding apparatus according to claim 6, wherein the control module, the coarse position control module, and the fine position control module are integrated into one module.

13. The web transportation guiding apparatus according to claim 1, wherein the fine position guiding module further comprises:

a fine position sensor, for sensing the position of the specific position on the web to generate a fine position sensing signal;

a fine position control module, electrically connected to the fine position sensor, for generating a fine position control signal according to the fine position sensing signal; and an adjustment mechanism, electrically connected to the fine position control module, for generating an adjustment motion according to the fine position control signal so as to adjust the position of the web.

14. The web transportation guiding apparatus according to claim 13, wherein the adjustment mechanism further comprises:

a pair of rollers, for clamping the web; and a linear moving platform, coupled to the pair of rollers, for driving the pair of rollers to generate a linear displacement motion according to the fine position control signal.

15. The web transportation guiding apparatus according to claim 13, wherein the roller above the web further has a recess.

16. The web transportation guiding apparatus according to claim 13, wherein the adjustment mechanism further comprises:

a suction roller, disposed at a bottom of the web, for adsorbing the web by a negative pressure; and a linear moving platform, coupled to the suction roller, for driving the suction roller to generate a linear displacement motion according to the fine position control signal.

17. The web transportation guiding apparatus according to claim 16, wherein the suction roller further comprises:

an outer sleeve, having a plurality of first through holes;

an outer roller, accommodated in the outer sleeve, and having a plurality of second through holes corresponding to the plurality of first through holes, wherein each of the second through holes is provided for accommodating a valve; and an inner roller, accommodated in the outer roller, and having a convex portion and a plurality of slots, wherein the convex portion leans against an inner wall of the outer roller.

18. The web transportation guiding apparatus according to claim 13, wherein the adjustment mechanism further comprises:

a friction roller, disposed at a bottom of the web, and having patterns on a surface thereof so as to lean against the web; and a linear moving platform, coupled to the friction roller, for driving the friction roller to generate a linear displacement motion according to the fine position control signal.

19. A web transportation guiding method, comprising:

providing a coarse position guiding module having an adjustment precision approximately in a range of hundreds of micrometers and a fine position guiding module having a control precision in a range of tens of micrometers, respectively, for a web to pass through and adjusting a position of the web, wherein the coarse position guiding module determines whether the position of the web is shifted according to a reference; and notifying the coarse position guiding module to change the reference if the fine position guiding module approaches a limit of a moving travel.

20. The web transportation guiding method according to claim 19, wherein the process of the fine position guiding module adjusting the position of the web further comprises:

detecting a position of a side edge of the web; and controlling the fine position guiding module to compensate a shift of the web if the position of the side edge is shifted.

21. The web transportation guiding method according to claim 20, wherein the fine position guiding module compensates the shift of the web by a translational motion.

22. The web transportation guiding method according to claim 19, wherein the process of the coarse position guiding module adjusting the position of the web further comprises:

detecting a position of a side edge of the web; and controlling the coarse position guiding module to adjust the position of the web if the position of the side edge is shifted.

23. The web transportation guiding method according to claim 22, wherein the coarse position guiding module compensates the shift of the web by a translational motion.

24. The web transportation guiding method according to claim 22, wherein the coarse position guiding module compensates the shift of the web by a rotational motion.

25. The web transportation guiding method according to claim 19, further comprising sending out an abnormal warning if the fine position guiding module approaches the travel limit.

* * * * *